US005752652A

United States Patent [19]

Castro

[11] Patent Number: 5,752,652

[45] Date of Patent: May 19, 1998

[54] ENVELOPE, AN ENVELOPE BLANK, AND A METHOD OF FORMING AN ENVELOPE BLANK

[76] Inventor: Carlos R. Castro, Apt. #27A, The Village Green, Budd Lake, N.J. 07828-1327

[21] Appl. No.: 802,914

[22] Filed: Feb. 20, 1997

[51] Int. Cl.[6] ..... B65D 27/38

[52] U.S. Cl. ..... 229/312; 229/310

[58] Field of Search ..... 229/310, 311, 229/312

[56] References Cited

U.S. PATENT DOCUMENTS

| | | | |
|---|---|---|---|
| 599,960 | 3/1898 | Gillette | 229/311 X |
| 1,328,028 | 1/1920 | Ahana | 229/310 X |
| 2,141,084 | 12/1938 | Hemphill | 229/311 |

FOREIGN PATENT DOCUMENTS

| | | | |
|---|---|---|---|
| 188035 | 8/1937 | Switzerland | 229/310 |

*Primary Examiner*—Jes F. Pascua

[57] ABSTRACT

An envelope blank, die cut from a sheet of flat paper stock, has a quadrilateral panel, a sealing flap, side flaps and a closure flap, with one of the side flaps having a slot formed therein to define a surmounting tab. A length of string is adhered to a fold obtaining between the panel and one of the side flaps, and lengthwise of the fold, and has a terminal end of the string adhered to the tab. With the tab externalized, the blank-formed envelope can be quickly and efficiently opened by pulling the tab away, and drawing the confined string out of the fold, whereby an end of the envelope is opened.

5 Claims, 4 Drawing Sheets

ENVELOPE, AN ENVELOPE BLANK, AND A METHOD OF FORMING AN ENVELOPE BLANK

This invention pertains to envelopes, envelope blanks, and methods of forming envelope blanks, and in particular to an envelope and a blank therefor as well as the blank-forming method, which facilitates a quick and efficient opening of the envelope.

A quick easier-to-open envelope has been sought for many years, and creative attempts toward such an envelope have been evidenced by prior patents. U.S. Pat. No. 180,773, issued to H. B. Magruder et al, on 8 Aug., 1876, disclosed an envelope which has a cutting string adhered along the right side thereof. At the top right-hand corner of the envelope is provided a diagonally-peforated tab in which an end of the cutting string is engaged. To open the envelope, one disengages the tab, and the string is pulled down. A disadvantage of this concept is that, upon the tab being torn free of the envelope, some of the letter contents may also be torn. Too, if the postage is emplaced with an adhesive label, detachment of the tab can be most difficult.

The U.S. Pat. No. 1,155,740, granted to F. X. J. Lacroix et al, on 5 Oct., 1915 also employs a cutting string placed in the bottom fold of the envelope. At opposite ends of the envelope, the string is secured in small, narrow, perforated tabs. Again, to open the envelope, one grasps one of the tabs, pulls it free of the body of the envelope, and pulls the string lengthwise of the envelope. Here too, the letter contents are susceptible of damage, by tearing, when the tab is torn free. Finally, emplacement of the cutting string lengthwise of the envelope causes the opening to take a little longer than if the string were enplaced along a shorter fold of the envelope.

W. W. L. Ahana was granted U.S. Pat. No. 1,328,028, on 13 Jan., 1920 for yet another envelope with a cutting string. In this concept, the string is emplaced along a longest fold, inside the top, seal flap. At one end of the seal flap, a tab is formed by cutting out a V-shaped notch. One end of the cutting string is adhered to this tab. Until the envelope is finally sealed, of course, the string is subject to damage and/or displacement. Also, frequently envelopes are sealed with transparent tape and, in such circumstances, the opening arrangement will be defeated.

On balance, the prior art envelopes with a tear-off tab require a tearing-off of a corner of the envelope, with attendant damage to the envelope cotents possible. The problem with the string adhered to the fold of the seal flap was discussed in the forgoing in connection with the Ahana patent. Some envelopes incorporate metal tabs, and these incur costs which greatly outweigh any advantage realized in quick opening.

Notwithstanding the thoughtful endeavors of others toward the matter, there remained a need for a quick-opening envelope which is (a) cost effective, (b) involves only a single, ergonomic motion to open the same, (c) is non-damaging of the contents, (d) complementary to standard, envelope die-cut methods, (e) is devoid of metal tabs, and (f) constructs from a novel blank which is formed from from common, flat paper stock.

It is an object of this invention, then, to meet the aforesaid need. Particularly, it is an object of this invention to set forth an envelope comprising a quadrilateral panel having opposite ends; a sealing flap joined to a given edge of said panel along a first fold line; and a pair of side flaps joined to said panel, at said ends thereof, along second and third fold lines; wherein said side flaps overlie said panel; a closure flap joined to another edge of said panel, which another edge parallels said given edge, along a fourth fold line; wherein said closure flap overlies said panel; a die cut slot, formed in one of said side flaps, defining a tab of a portion of said one side flap; a length of filamentary material adhered to, and along, one of said second and third fold lines; a terminal end of said filamentary material is adhered to said tab; said side flaps have edges which are in proximate relationship to said closure flap; said closure flap also overlies said edge of one of said side flaps, and overlies a portion of said edge of the other of said side flaps; and said tab overlies said closure flap.

This invention has as another object the disclosure of a novel envelope blank comprising a quadrilateral panel having opposite ends; a sealing flap joined to a given edge of said panel along a first fold line; a pair of side flaps joined to said panel, at said ends thereof, along second and third fold lines; a closure flap joined to another edge of said panel, which another edge parallels said given edge, along a fourth fold line; and a die cut slot, formed in one of said side flaps, defining a tab of a portion of said one side flap.

Concomitantly, it is an object of this invention to set forth a method of forming the aforesaid envelope blank, comprising the steps of providing a sheet of flat paper stock; die cutting said sheet to form thereof (a) a quadrilateral panel with opposite ends, (b) a sealing flap joined to a given edge of said panel along a first fold line, (c) a pair of side flaps joined to said panel, at said ends thereof, along second and third fold lines, and (d) a closure flap joined to said another edge of said panel, which another edge parallels said given edge, along a fourth fold line; and forming a slot, in one of said side flaps, to define a tab of a portion of said one side flap.

Further objects of this invention, as well as the novel features thereof, will become apparent, by reference to the following description, taken in conjunction with the accompanying figures, in which.

Figure 1:
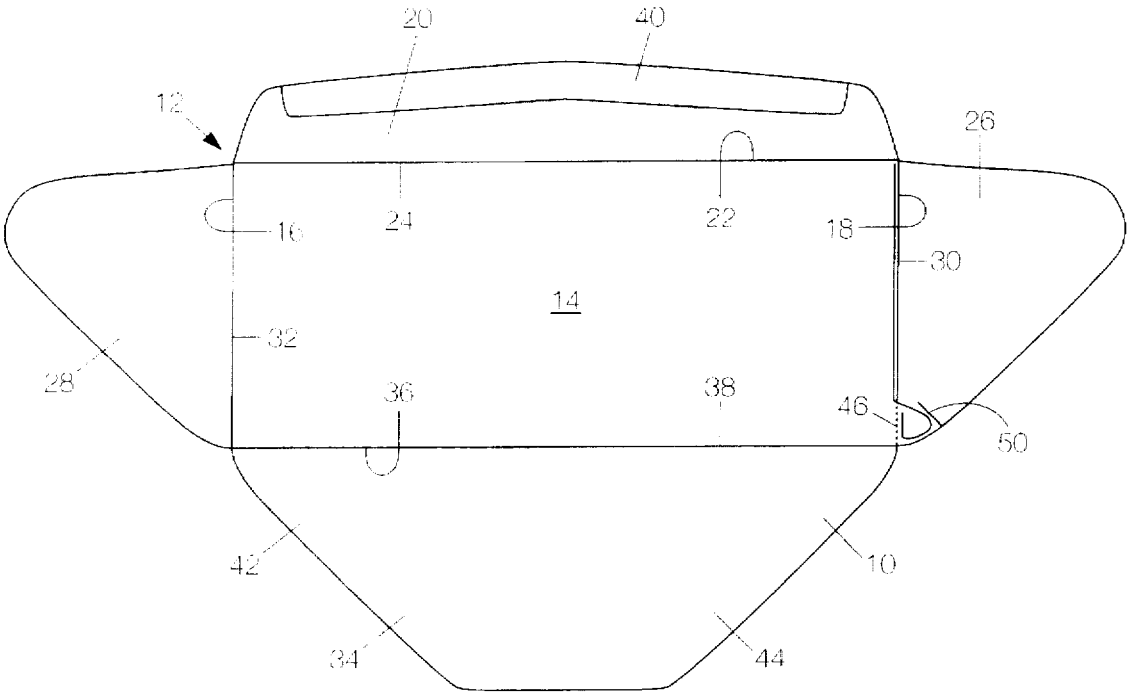
FIG. 1 depicts a plan view of an envelope blank, according to an embodiment of the invention.

As shown in FIG. 1, a sheet 10 of flat, paper stock has been die cut to form an envelope blank 12. The blank 12 comprises a quadrilateral panel 14 having opposite ends 16 and 18, a sealing flap 20 joined to a given edge 22 of the panel 14, along a first fold line 24, a pair of side flaps 26 and 28 are joined to the panel 14, at the ends 16 and 18 thereof, along second and third fold lines 30 and 32.

A closure flap 34, joined to said panel 14, along another edge 36 defines another fold line 38. The sealing flap 20 has an adhesive swatch 40 as is conventional, and edge portions 42 and 44 of the closure flap 34 can also have adhesive (not shown).

Figure 2:
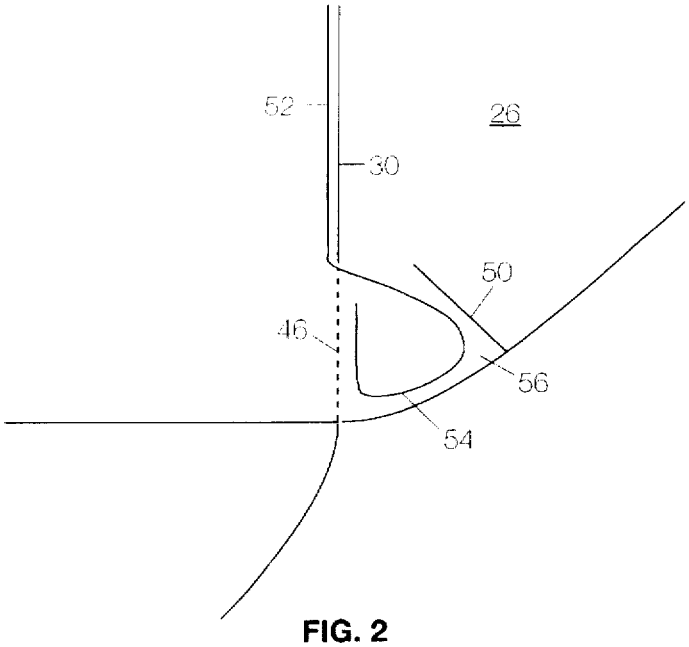
FIG. 2 is an enlarged, fragmental view of a corner of the envelope blank of FIG. 1, the same showing the die cut tab.

A right-hand corner of the junction of the panel 14 with the right-hand side flap 26 has a perforated portion 46, and an adjacent portion of the flap 26 has a short, die cut slot 50 formed therein. A length of string 52 is glued lengthwise of, and along, the second fold line 30 and, as can be seen with particular clarity in FIG. 2, a terminal end 54 of the string 52 is glued to a tab 56 which obtains between the die cut slot 50 and the perforated portion 46.

Figure 3:
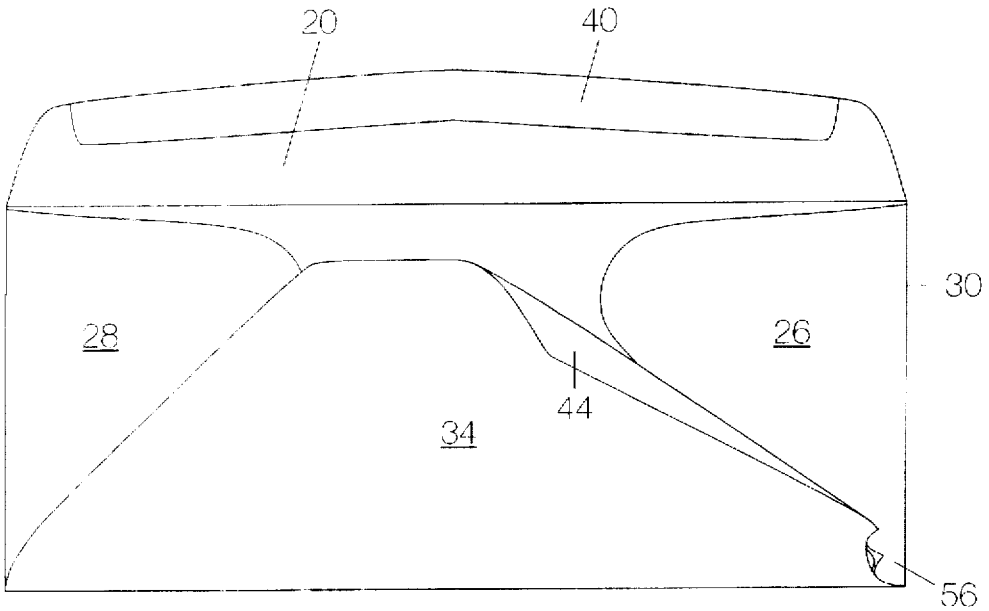
FIG. 3 is a plan view of an envelope, constructed according to an embodiment of the invention, in which the closure flap is being adhered to just a portion of the right-hand, side flap.
Figure 4:
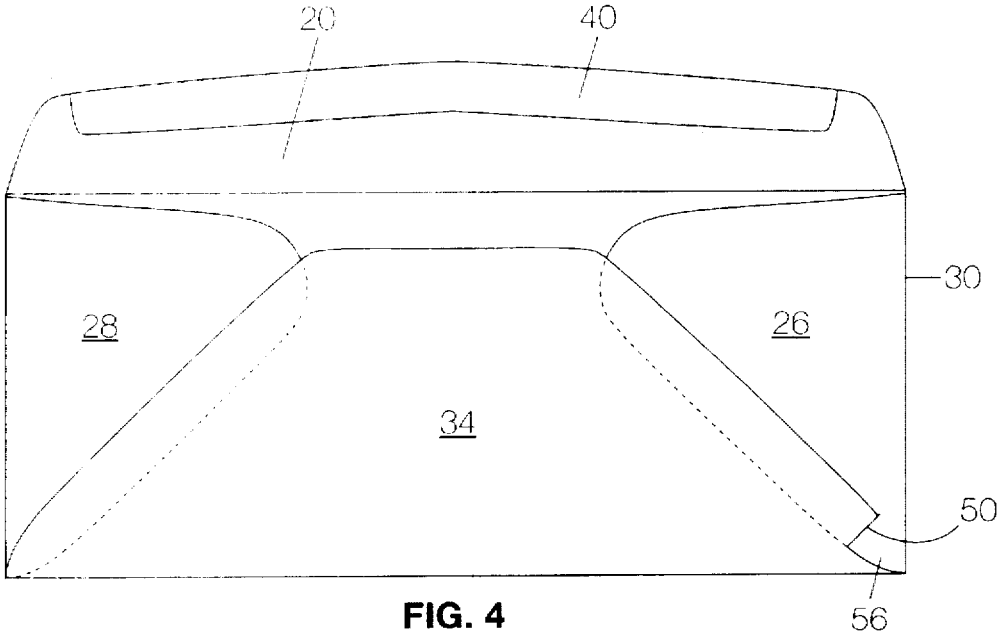
FIG. 4 is a view like that of FIG. 3 in which, however, the tab is shown overlying the closure flap.

FIG. 3 shows how the closure flap 34 is caused to overlie the edge of the side flap 28, which edge is most proximate to the closure flap 34, and the closure flap 34 is proceeding to overlie a portion of the proximate edge of side flap 26. The portion of the side flap 26 which constitutes the tab 56 is not overlied by the closure flap 34. On the contrary, the closure flap 34 has its edge which aligns with the slot 50 enter the slot, and the tab 56 overlies the closure flap 34. FIG. 4 shows the tab 56 set over the closure flap, with the envelope 58 ready for its insertion, and sealing of the sealing flap 20 onto the closure flap 34 and the upper portions of the side flaps 26 and 28.

Figure 5:
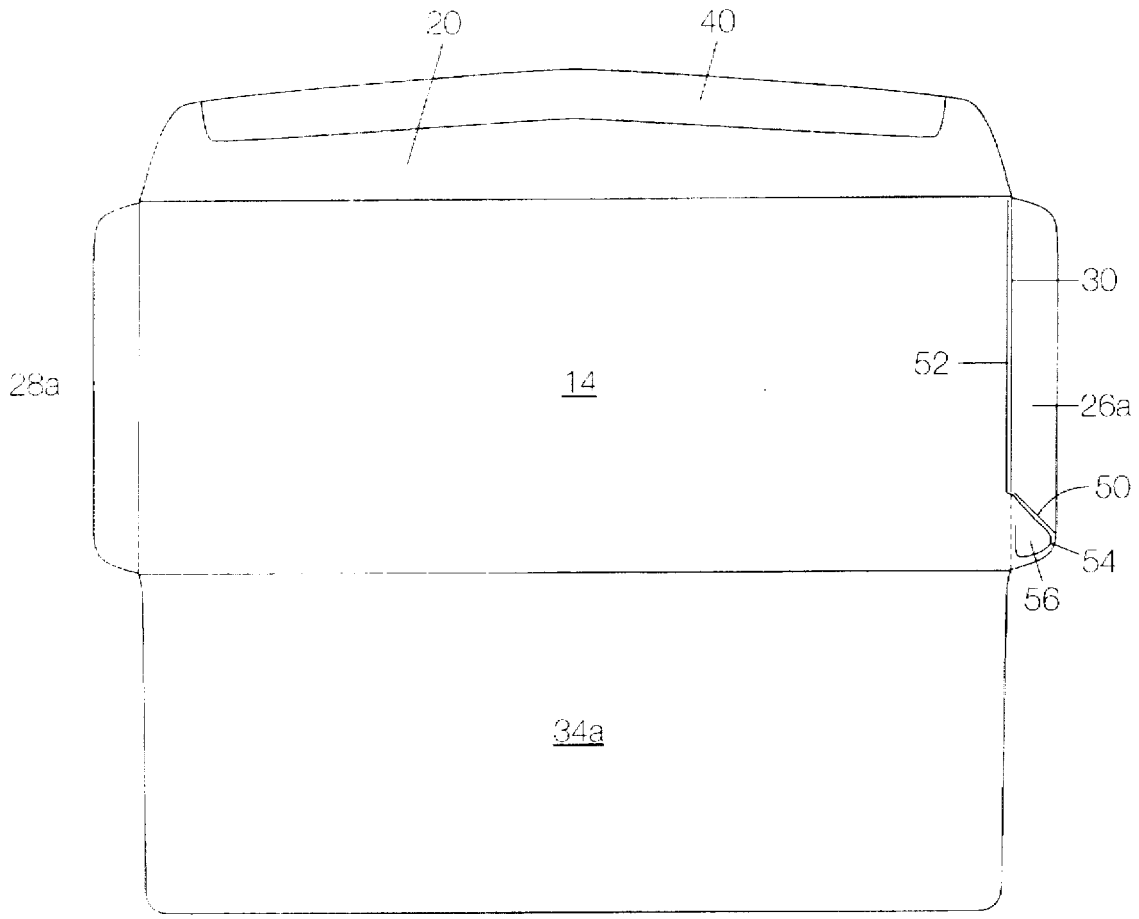
FIG. 5 illustrates an envelope blank, according to the invention, of a different configuration.
Figure 5A:
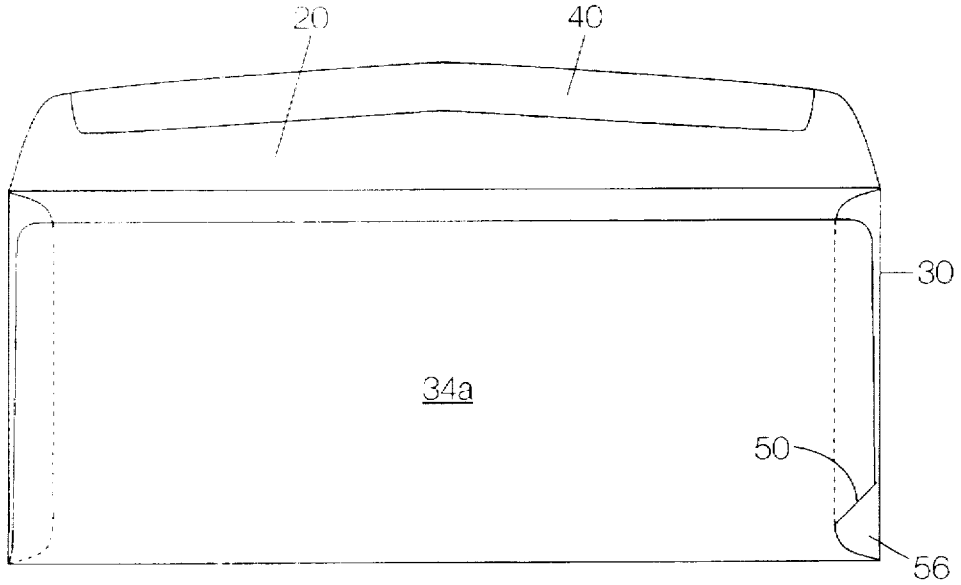
FIG. 5A depicts the envelope formed of the blank of FIG. 5.

FIGS. 5 and 5A illustrate the invention in connection with an envelope blank and envelope of a configuration differing from that shown in FIGS. 1–4. Index numbers, in FIGS. 5 and 5A, which are the same as or similar to those in FIGS. 1–4 denote same or similar elements as those in FIGS. 1–4.

Figure 6:
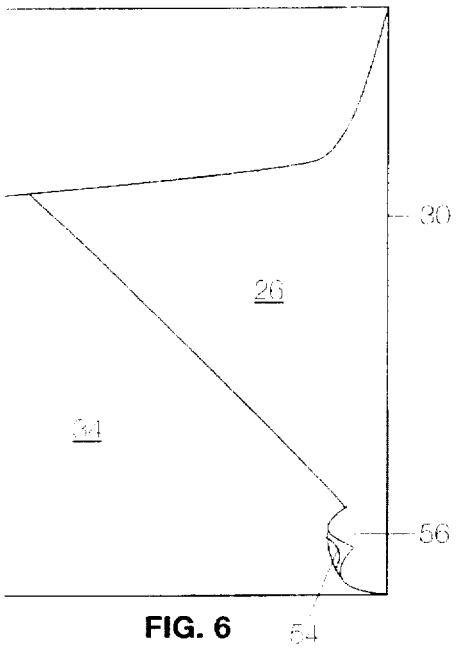
FIGS. 6 through 9 depict the progressive opening of an envelope which incorporates the invention therein.
Figure 7:
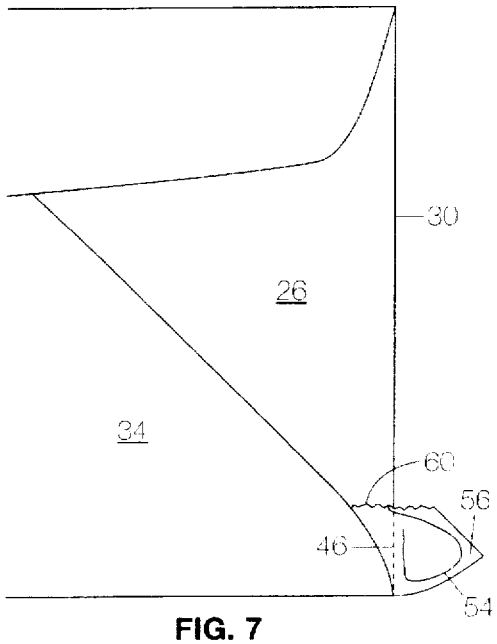
Figure 8:
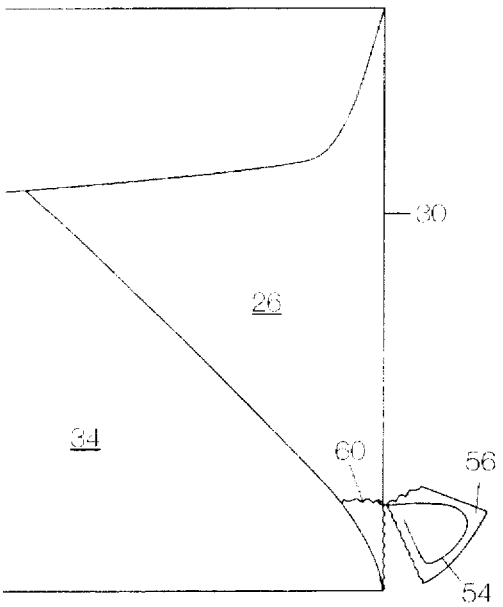
Figure 9:
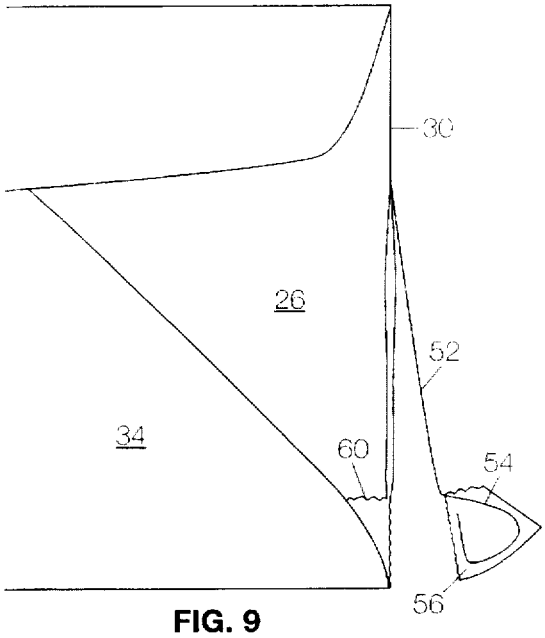

FIGS. 6 through 9 illustrate the simplicity of envelope opening with the present invention. As depicted in FIG. 6, the tab 56 is gripped, and pulled toward the fold line 30, tearing the flap 26 along a short length 60, the latter being shown in FIG. 7. Next, as shown in FIG. 8, the tab 56 is drawn toward the right, to open up the perforated portion 46. Finally, the tab 56 is pulled away from the envelope 58, as shown in FIG. 9, to cause the string 52 to open up the fold line 30.

While I have described my invention in connection with specific embodiments thereof, it is to be clearly understood that this is done only by way of example, and not as a limitation to the scope of the invention, as set forth in the objects thereof, and in the appended claims. The envelope-opening article has been described as string 52. However, self-evidently, such string could be replaced by filamentary plastic, or wire, or the like. Too, perforations, die cuts and such could be supplanted by score lines, in some of the applications, to yield the same results. Accordingly, all such modifications and/or substitutions are deemed to be within the ambit of the invention, and embraced by the ensuing claims.

I claim:

1. An envelope, comprising:

a quadrilateral panel having opposite ends;

a sealing flap joined to a given edge of said panel along a first fold line; and a pair of side flaps joined to said panel, at said ends thereof, along second and third fold lines; wherein said side flaps overlie said panel;

a closure flap joined to another edge of said panel, which another edge parallels said given edge, along a fourth fold line;

wherein said closure flap overlies said panel;

a die cut slot, formed in one of said side flaps, defining a tab of a portion of said one side flap;

a length of filamentary material adhered to, and along, one of said second and third fold lines;

a terminal end of said filamentary material is adhered to said tab;

said side flaps have edges which are in proximate relationship to said closure flap;

said closure flap also overlies said edge of one of said side flaps, and overlies a portion of said edge of the other of said side flaps; and said tab overlies said closure flap.

2. An envelope, according to claim 1, wherein:

said side flaps are identical in configuration.

3. An envelope, according to claim 1, wherein:

said closure flap is adhered to said edge of said one of said side flaps, and to said portion of said edge of said other of said side flaps.

4. An envelope, according to claim 1, wherein:

said side flaps are of a substantially triangular shape.

5. An envelope, according to claim 1, wherein:

said side flaps are of a substantially rectangular shape.

* * * * *